US008801576B1

(12) United States Patent
Shin

(10) Patent No.: US 8,801,576 B1
(45) Date of Patent: Aug. 12, 2014

(54) VIBRATORY EXERCISE APPARATUS HAVING ELECTRICITY GENERATING FUNCTION

(71) Applicants: ENS Tech Co., Ltd., Pocheon-si (KR); Hee Sub Shin, Seoul (KR)

(72) Inventor: Hee Sub Shin, Seoul (KR)

(73) Assignees: ENS Tech Co., Ltd., Pocheon-si, Gyeonggi-do (KR); Hee Sub Shin, Seoul (KR)

( * ) Notice: Subject to any disclaimer, the term of this patent is extended or adjusted under 35 U.S.C. 154(b) by 0 days.

(21) Appl. No.: 13/905,463

(22) Filed: May 30, 2013

(30) Foreign Application Priority Data

Feb. 15, 2013 (KR) ..... 10-2013-0016634

(51) Int. Cl.
*A63B 24/00* (2006.01)

(52) U.S. Cl.
USPC ..... 482/2; 482/1; 482/8; 482/9

(58) Field of Classification Search
USPC ..... 482/1–9, 900–902; 601/1–3, 33, 48, 52, 601/66, 78
See application file for complete search history.

(56) References Cited

U.S. PATENT DOCUMENTS

| | | | | |
|---|---|---|---|---|
| 5,484,388 | A * | 1/1996 | Bassett et al. | 601/27 |
| 7,418,108 | B2 * | 8/2008 | Oser | 381/401 |
| 8,360,999 | B2 * | 1/2013 | Leung et al. | 601/78 |

FOREIGN PATENT DOCUMENTS

| | | | |
|---|---|---|---|
| KR | 10-0620147 | B1 | 9/2006 |
| KR | 10-0651766 | B1 | 12/2006 |
| KR | 10-1234882 | B1 | 2/2013 |

* cited by examiner

*Primary Examiner* — Glenn Richman
(74) *Attorney, Agent, or Firm* — Novick, Kim & Lee, PLLC; Jae Youn Kim

(57) ABSTRACT

Provided is a vibratory exercise apparatus having a frame and a handle, including: upper and lower plates formed to be spaced apart from each other at a predetermined interval; a vibrator disposed on a center of the lower plate, having upper and lower vibration plates and installed to be vibrated up and down, and configured to vibrate an operating unit up and down by receiving a drive signal so that the upper plate in contact with the operating unit is vibrated up and down; and a plurality of vibration absorbing units disposed between the upper plate and the lower plate so as to maintain predetermined intervals in an edge region of the lower plate and configured to absorb an impact generated when the upper plate is lowered while the upper plate is vibrated.

5 Claims, 10 Drawing Sheets

VIBRATORY EXERCISE APPARATUS HAVING ELECTRICITY GENERATING FUNCTION

CROSS-REFERENCE TO RELATED APPLICATIONS

This application claims priority to and the benefit of Korean Patent Application No. 10-2013-0016634 filed in the Korean Intellectual Property Office on Feb. 15, 2013, the entire contents of which are incorporated herein by reference.

TECHNICAL FIELD

The present invention relates to a vibratory exercise apparatus capable of providing an exercise effect through a foot plate which is vertically vibrated, and more particularly, to a vibratory exercise apparatus having an electricity generating function which generates electricity to be used as an auxiliary power source by using an armature coil while a foot plate or an upper plate to which the foot plate is coupled performs a precise vertical vibration motion.

BACKGROUND ART

In general, obese patients tend to increase due to ingestion of high-calorie food and lack of exercise. It is well known that obesity is factor causing adult diseases such as heart disease, high blood pressure, and diabetes. In the field of orthopedics, doctors are interested in obesity because it is known that obesity is especially involved with occurrence of osteoarthritis.

Recently, childhood obesity, especially, abdominal obesity is sharply increasing due to a high-calorie dietary life culture and using a computer for long hours for handling business affairs and playing computer games. Adults may treat corpulence according to their own will through diet meals and suitable exercises. However, it is difficult to apply obesity treatments for adults such as diet meals and suitable exercises to childhood obesity. That is, exercise apparatuses that enable a user to do aerobic exercises effectively while avoiding extreme exercises as far as possible are highly needed.

In particular, in case of serious obesity, a walking or jogging exercise often negatively affect the joints of the knee. Accordingly, persons who suffer from serious obesity have a tendency to avoid the walking or jogging exercise. As a result, the persons who suffer from the serious obesity use an abdominal vibration belt as a small impact exercise as well as an aerobic exercise, or use a running machine or the like which is operated at a low speed.

Vertical exercise apparatuses are being proposed as exercise equipment that helps aerobic exercises but does not affect the joints of knees. The exercise equipment using a rotating motor in a vibrator has been known as a vertical exercise apparatus of the related art. The rotary type vertical exercise apparatuses apply vibration only at the abdominal region according to setting of a proper frequency, thereby enabling convenient aerobic exercise. As a result, the rotary type vertical exercise apparatuses are being medically used for abdominally obese patients, specifically.

Among the vertical exercise apparatuses in the related art, Korean Patent No. 651766 suggests a magnetic circuit having a dual magnet, and a speaker and a vibration generator device using the magnetic circuit, and Korean Patent No. 620147 suggests a vibration type exercise apparatus using a vibration generator device. However, when a user stands off-center on a foot plate, the foot plate is distorted, and as a result, vibration is not uniform but fluctuates, and a lot of noise is created. In addition, a vibrator merely serves to provide vibration to the foot plate.

SUMMARY OF THE INVENTION

The present invention has been made in an effort to provide a vibratory exercise apparatus having an electricity generating function, which generates electricity by using an armature coil separately provided inside a vibrator while the vibrator is vertically vibrated based on a vibration signal such as a sinusoidal wave to vertically vibrate a foot plate, and allows electricity to be used as an auxiliary power source for charging a mobile phone, for example.

An exemplary embodiment of the present invention provides a vibratory exercise apparatus having a frame and a handle, including: upper and lower plates formed to be spaced apart from each other at a predetermined interval; a vibrator configured to vertically vibrate the upper plate up and down including an operating unit fixed to a center of the upper plate and having a magnet installed, and a bobbin unit installed on the lower plate at a position corresponding to the operating unit and having a coil wound on the bobbin unit and configured to generate a magnetic field by receiving a drive signal; and a vibration absorbing unit installed between the upper plate and the lower plate and configured to absorb an impact generated when the upper plate is lowered while the upper plate is vertically vibrated up and down, in which the operating unit of the vibrator includes an operating unit cover formed as a circular plate made of a magnetic material and having a plurality of fastening holes for fastening to the upper plate, an outer ring fastened to an edge of the cover and formed in an annular shape having a predetermined height, an inner ring installed to be spaced apart from the outer ring at a predetermined interval while forming a concentric circle inside the outer ring, a center post installed to be spaced apart from the inner ring while forming a concentric circle inside the inner ring, a vibration generating magnet made of a ferromagnetic material, attached between one side of the inner ring and the operating unit cover, and configured to magnetize the inner ring and the outer ring, and an electricity generating magnet installed on a protruding end of the center post, and the bobbin unit of the vibrator includes an inner bobbin having a center hole which the magnet of the center post is drawn into and out, and an electricity generating coil wound on an outer circumferential surface, an outer bobbin installed to be spaced apart from the inner bobbin at an interval that allows the inner ring of the operating unit to be drawn into and out, while forming a concentric circle outside of the inner bobbin, and having a vibration generating coil wound on an outer circumferential surface, and a bobbin cover coupled to the inner bobbin and the outer bobbin, and having a plurality of fastening holes for fastening to the lower plate.

In addition, a drive signal control unit, which applies a drive signal having a sinusoidal waveform, may be connected to the vibration generating coil.

In addition, a heat radiation fan, which cools the vibrator by air, may be installed at a position adjacent to the vibrator.

In addition, the inner ring and the outer ring may be fixed to the operating unit cover by magnetic force of the electricity generating magnet that is made of a ferromagnetic material, without using a separate fastening means.

In addition, a height where the electricity generating magnet is positioned may be lower than a height of the inner ring.

In addition, a spacer made of a non-magnetic material and having one or more cooling holes and one or more fastening holes may be installed between the upper plate and an upper end of the vibrator.

The present invention configured as described above, generates electricity by using the armature coil installed inside the vibrator while the upper plate of the foot plate performs precise vertical vibration motion by an operation of the vibrator, and the generated electricity may be used as an auxiliary power source for charging a mobile phone, and as a result, there is an effect in that energy may be saved.

DETAILED DESCRIPTION

Hereinafter, an exemplary embodiment of the present invention will be described in detail with reference to the accompanying drawings based on parts necessary to understand operations and actions according to the present invention.

Figure 1:
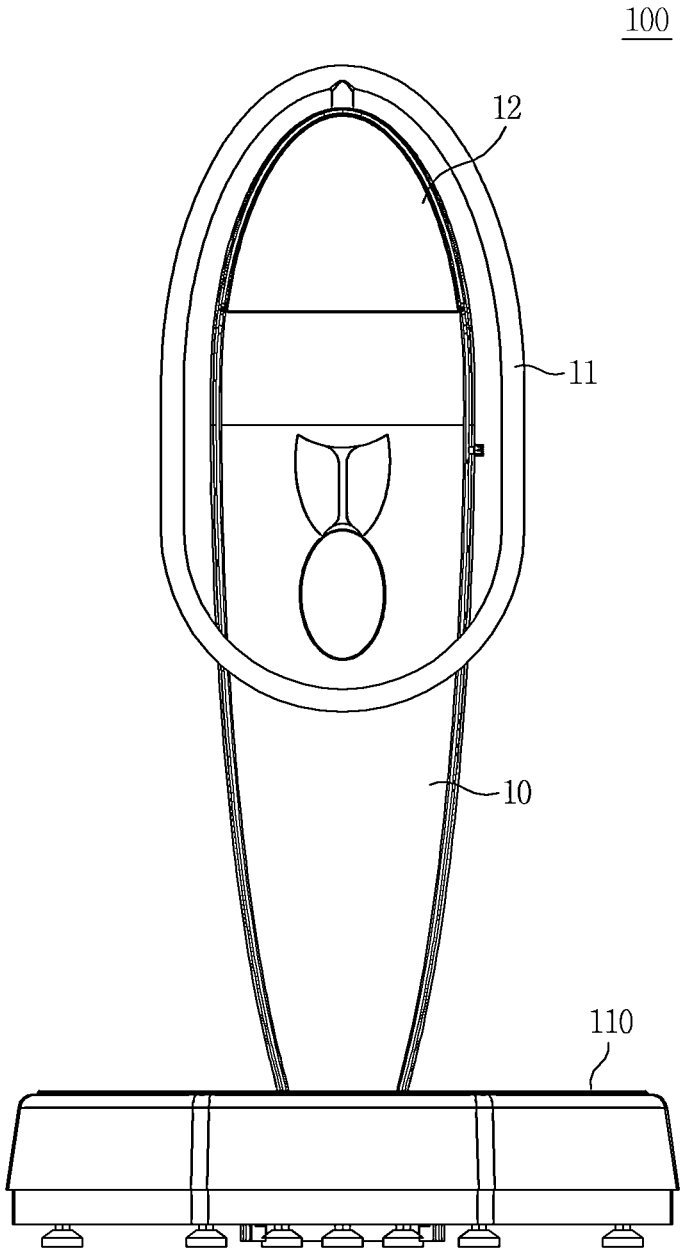
FIG. 1 is a front view of a vibratory exercise apparatus according to an exemplary embodiment of the present invention.
Figure 2:
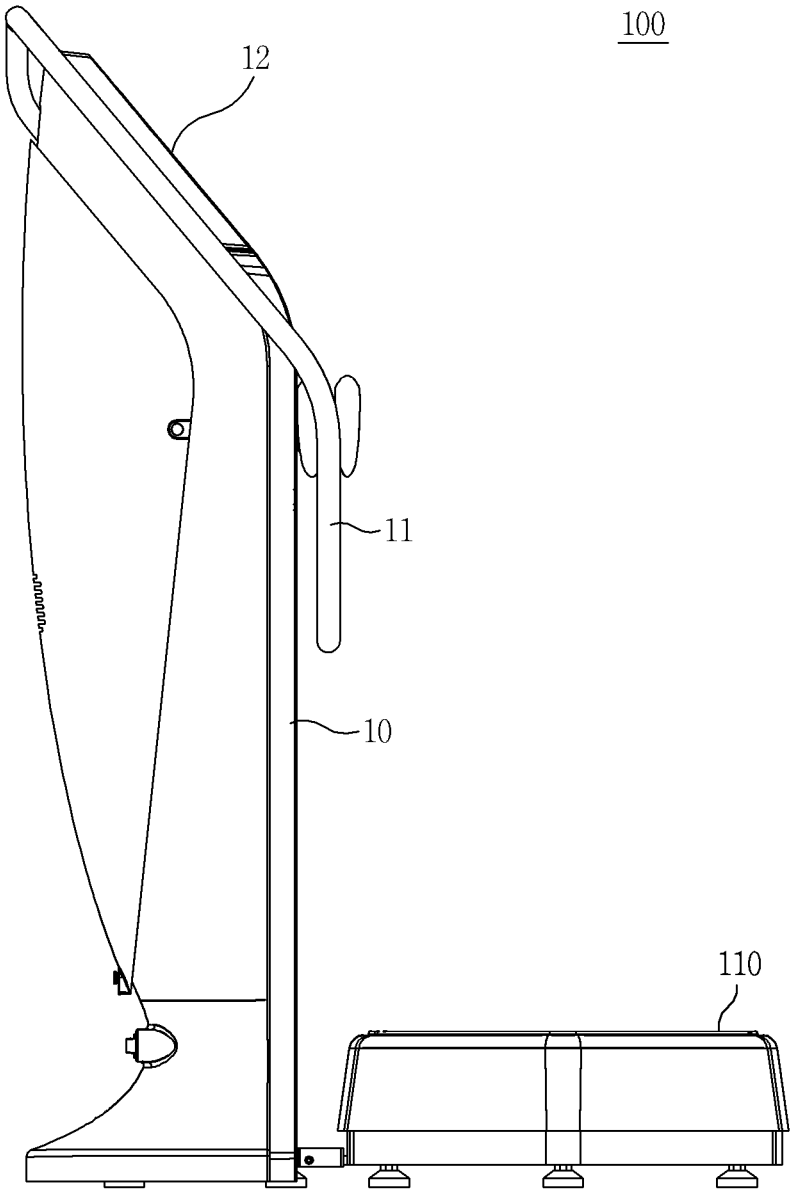
FIG. 2 is a side view of the vibratory exercise apparatus according to the exemplary embodiment of the present invention.

As illustrated in FIGS. 1 and 2, a vibratory exercise apparatus 100 according to an exemplary embodiment of the present invention includes a foot plate 110 including upper and lower plates 110*a* and 110*b* in which the upper plate 110*b* is precisely and vertically vibrated, a control body 10 vertically installed on the foot plate 110 and having a handle 11 for stable use while exercising installed in a forward direction, and a display unit 12 installed on an upper end of the control body 10 to display an operational state, or the like.

The handle 11, the display unit 12, or the like are not an essential constituent element for achieving the object of the present invention and may be modified in accordance with the purpose of use, and may determine whether or not the constituent elements need to be installed.

Figure 3:
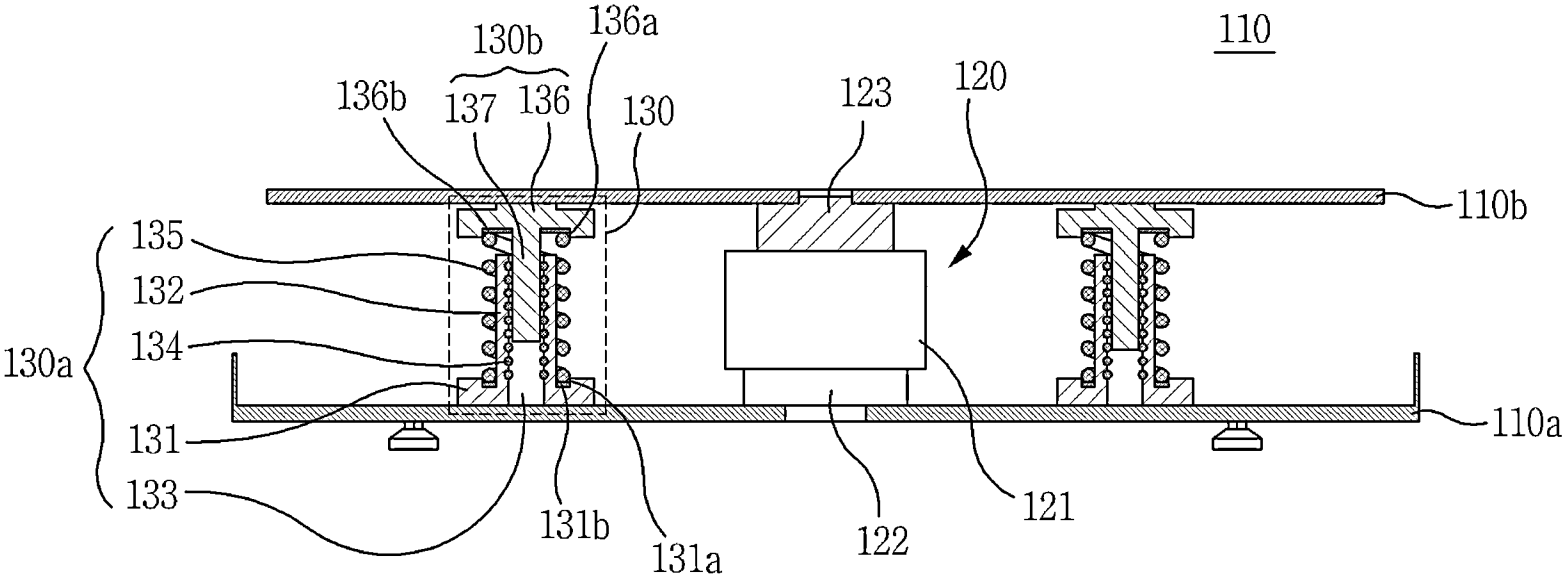
FIG. 3 is a cross-sectional view of a foot plate of the vibratory exercise apparatus according to the exemplary embodiment of the present invention.

As illustrated in FIG. 3, the upper and lower plates 110*a* and 110*b* of the foot plate 110 are installed to be spaced apart from each other at a predetermined interval and in parallel to each other in a horizontal direction. The upper and lower plates 110*a* and 110*b* may have an area such that the user may stand by spreading both feet apart by about shoulder width.

A vibrator 120 coupled to a center between the upper and lower plates 110*a* and 110*b* includes an operating unit 121 in which a magnet is installed, and a bobbin unit 122 on which a coil is wound. The bobbin unit 122 is fixed to a center of the lower plate 110*a*, and the operating unit 121 is fixed to a center of the upper plate 110*b* at a position corresponding to the bobbin unit 122, such that the operating unit 121 is vibrated to vibrate the upper plate 110*b* by actions of attractive force and repulsive force between a magnetic field formed by an electric current applied to the coil of the bobbin unit 122 and a magnetic field formed by the magnet of the operating unit 121.

Hereinafter, a configuration and an operation of the vibrator 120 will be described in more detail with reference to FIGS. 4 to 8.

Figure 4:
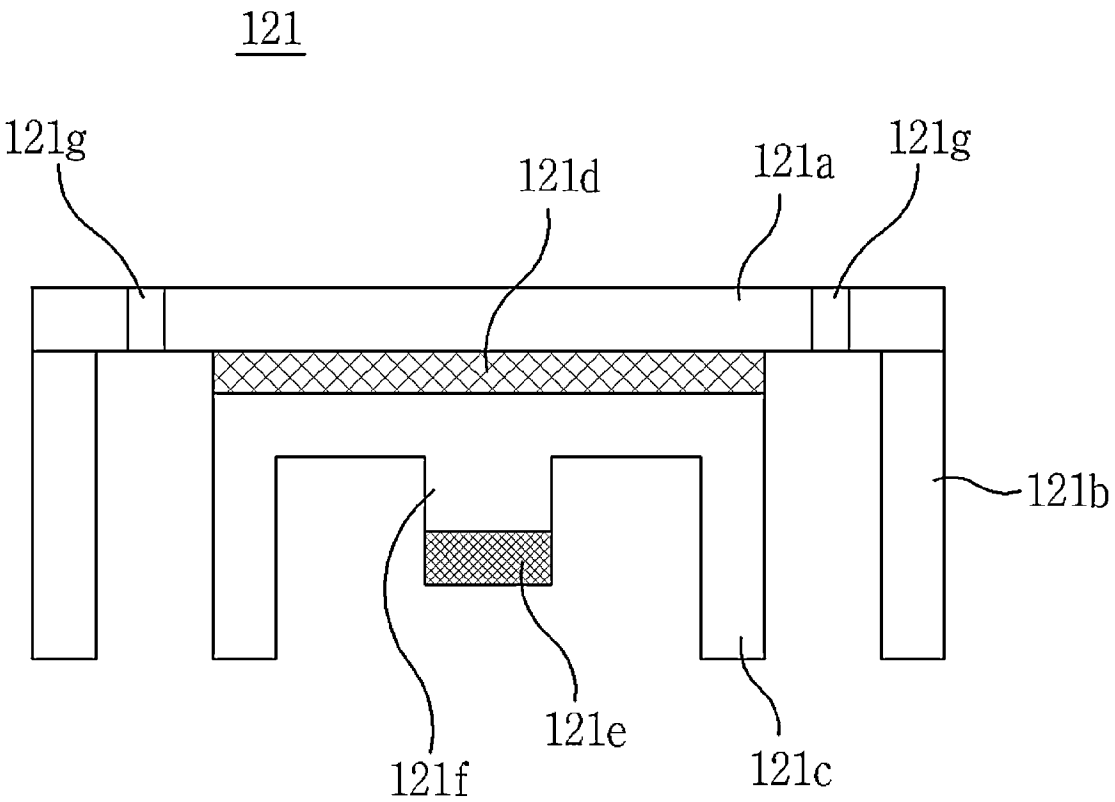
FIG. 4 is a cross-sectional view of a vibrator operating unit according to the exemplary embodiment of the present invention.
Figure 5:
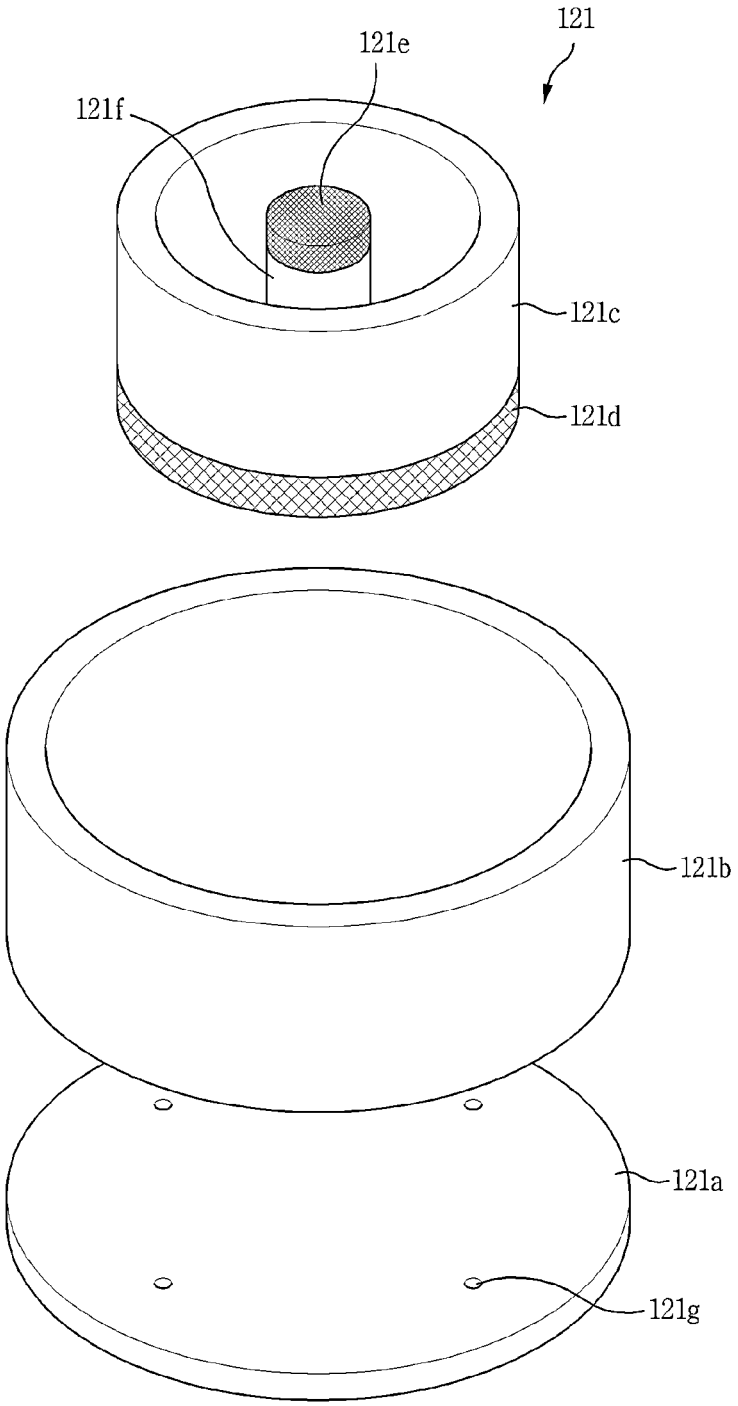
FIG. 5 is an exploded view of the vibrator operating unit according to the exemplary embodiment of the present invention.

As illustrated in FIGS. 4 and 5, the operating unit 121 of the vibrator 120 may include an operating unit cover 121*a*, an outer ring 121*b*, an inner ring 121*c*, a vibration generating magnet 121*d*, a center post 121*f*, and an electricity generating magnet 121*e*.

The operating unit cover 121*a* is fastened to the upper plate 110*b* and has a predetermined radius with a plurality of fastening holes 121*g*. Here, an upper portion of the operating unit cover 121*a* is in contact with one surface of a spacer 123, which will be described below, and may be fixed to the upper plate 110*b* by fastening members (not illustrated) penetrating through fastening holes 121*g* formed in the operating unit cover 121*a* and fastening holes 123*b* formed in the spacer 123, respectively.

The outer ring 121*b* is fastened to the operating unit cover 121*a*, and formed in an annular shape having a predetermined height. The outer ring 121*b* may be fastened along an edge of the operating unit cover 121*a*.

The inner ring 121*c* has a concentric circle with the outer ring 121*b*, and is formed in an annular shape having a predetermined height like the outer ring 121*b*, and installed inside of the outer ring 121*b*.

The operating unit cover 121*a*, the outer ring 121*b*, and the inner ring 121*c* are made of a magnetic material, that is a material magnetized when put in a magnetic field. Therefore, the inner ring 121*c* and the outer ring 121*b* are magnetized by attaching the vibration generating magnet 121*d*, which is made of a ferromagnetic material having a size corresponding to a diameter of the inner ring 121*c*, between the inner ring 121*c* and the operating unit cover 121*a*, and by attaching the outer ring 121*b* on an edge of the operating unit cover 121*a*. In particular, as the vibration generating magnet 121*d* is made of a ferromagnetic material, the inner ring 121*c* and the outer ring 121*b* may be fixed to the operating unit cover 121*a* without using a separate fastening means.

The vibration generating magnet 121*d* may vibrate the operating unit 121 up and down in a vertical direction by interaction with a vibration generating coil 122*b*, which will be described below, while forming a strong magnetic field.

Meanwhile, the center post 121*f* is provided to install the electricity generating magnet 121*e* for generating electricity, and formed to protrude in a cylindrical shape from a center of the inner ring 121*c*. The center post 121*f* protrudes from the center of the inner ring 121*c* in a cylindrical shape, may protrude to have a height smaller than the height of the inner ring 121*c*, and may be preferred to be integrally formed with the inner ring 121*c*.

The electricity generating magnet 121*e* is fastened to a protruding end of the center post 121*f* and made of a ferromagnetic material. The electricity generating magnet 121*e* forms a magnetic field at the periphery of an electricity generating coil 122*d*, which will be described below, to generate electricity.

Here, the height where the electricity generating magnet 121*e* is positioned may be set to a position where leakage magnetic flux is minimized when the electricity generating coil 122*d* interlinks with magnetic flux generated on the electricity generating magnet 121*e* by vibration of the operating unit 121.

Figure 6:
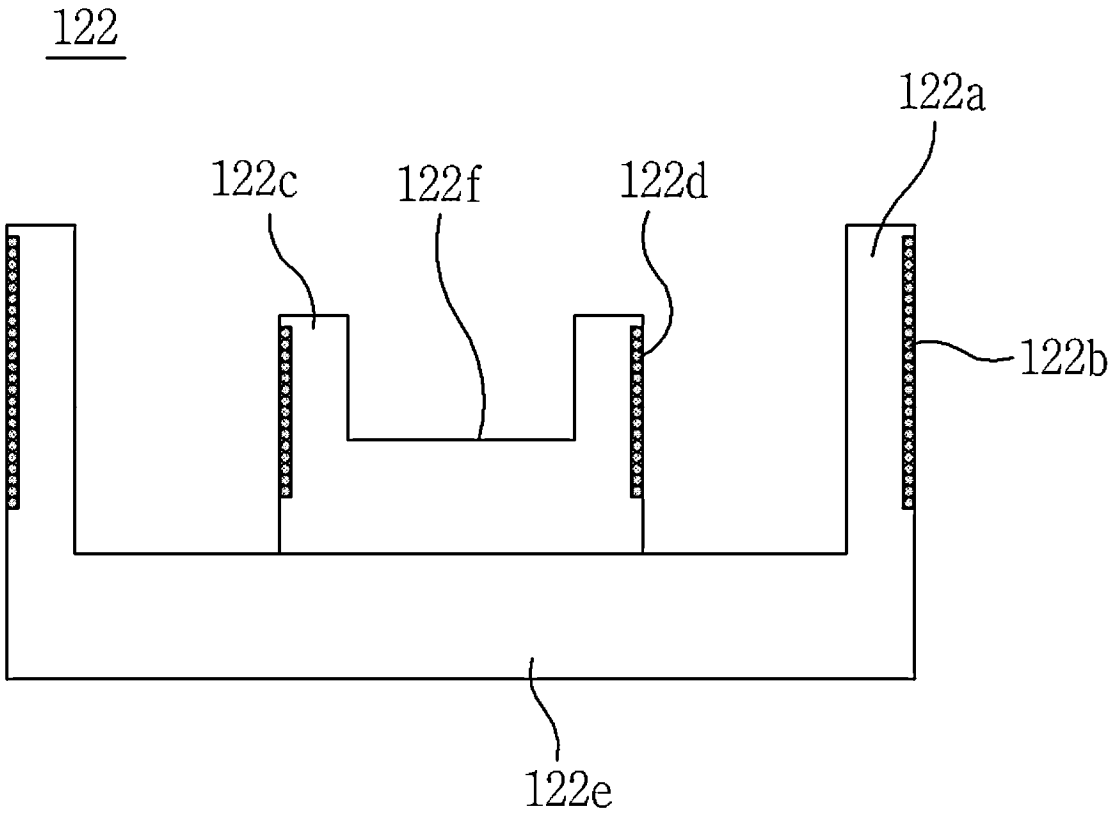
FIG. 6 is a cross-sectional view of a vibrator bobbin unit according to the exemplary embodiment of the present invention.
Figure 7:
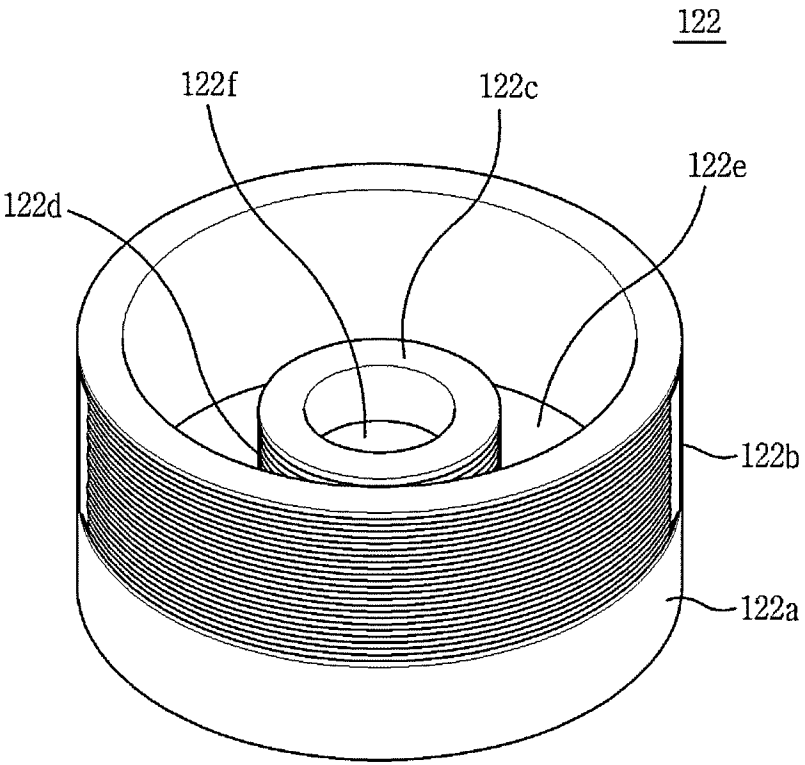
FIG. 7 is a perspective view of the vibrator bobbin unit according to the exemplary embodiment of the present invention.
Figure 8:
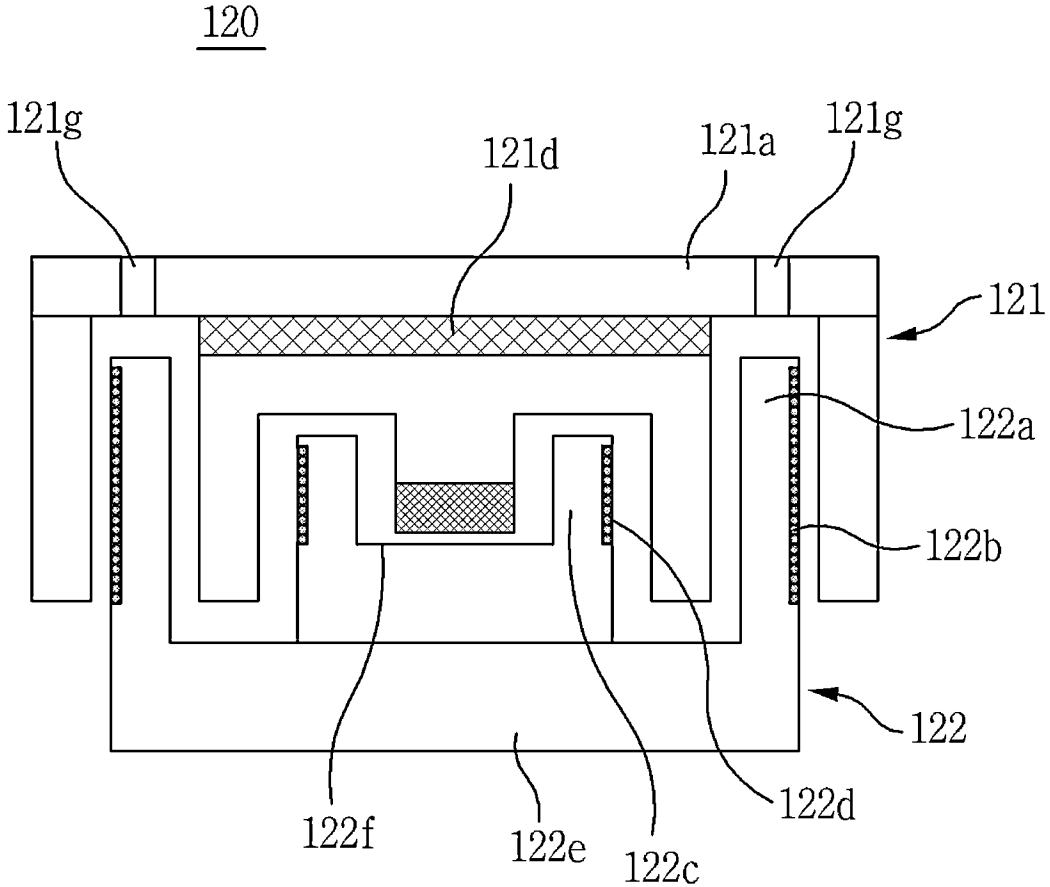
FIG. 8 is an assembled perspective view of the bobbin unit and the operating unit of the vibrator according to the exemplary embodiment of the present invention.

In addition, as illustrated in FIGS. 6 and 7, the bobbin unit 122 may include an outer bobbin 122*a*, the vibration generating coil 122*b* wound on an outer circumferential surface of the outer bobbin 122*a*, an inner bobbin 122*c*, and the electricity generating coil 122*d* wound on outer circumferential surface of the inner bobbin 122*c*.

The outer bobbin 122*a* is fastened to the lower plate 110*a* through a bobbin cover 122*e*, and formed in an annular shape to be drawn into and out of a portion between the outer ring 121*b* and the inner ring 121*c*. To this end, a thickness of the outer bobbin 122*a* may be somewhat smaller than a separation distance between the inner ring 121*c* and the outer ring 121*b* such that there is no interference by the inner ring 121*c* and the outer ring 121*b* when the outer bobbin 122*a* is drawn into and out of a portion between the outer ring 121*b* and the inner ring 121*c* (see FIG. 8).

The vibration generating coil 122*b* is wound on the outer circumferential surface of the outer bobbin 122*a*, and forms a magnetic field of which polarity is alternately changed when a signal having a sinusoidal waveform is applied to the vibration generating coil 122*b*. As such, the operating unit 121 is vertically vibrated up and down by attractive force and repulsive force generated in accordance with a polarity of a magnetic field generated on the vibration generating coil 122*b* and a polarity of a magnetic field generated on the vibration generating magnet 121*d*. The vibration generating coil 122*b* may vibrate the operating unit 121 up and down by receiving a drive signal having a sinusoidal waveform from a drive signal control unit 125 which will be described below.

The inner bobbin 122*c* is formed in an annular shape having a size smaller than the outer bobbin 122*a*, and installed to be able to be drawn into and out of a portion between the inner ring 121*c* and the center post 121*f*. In addition, the inner bobbin 122*c* has a circular groove 122*f* at a center thereof, which has a radius somewhat greater than a radius of the center post 121*f* so that the electricity generating magnet 121*e* installed on the center post 121*f* may be inserted into the circular groove 122*f*, and the outer circumferential surface of the inner bobbin 122*c* is formed to be smaller than the radius of the inner ring 121*c*. Further, the electricity generating coil 122*d* is wound on the outer circumferential surface of the inner bobbin 122*c*.

The electricity generating coil 122*d* generates electricity by interlinking with magnetic flux generated on the electricity generating magnet 121*e* when the electricity generating magnet 121*e* of the operating unit 121 is drawn into and out of an inside of the circular groove 122*f*.

Figure 9:
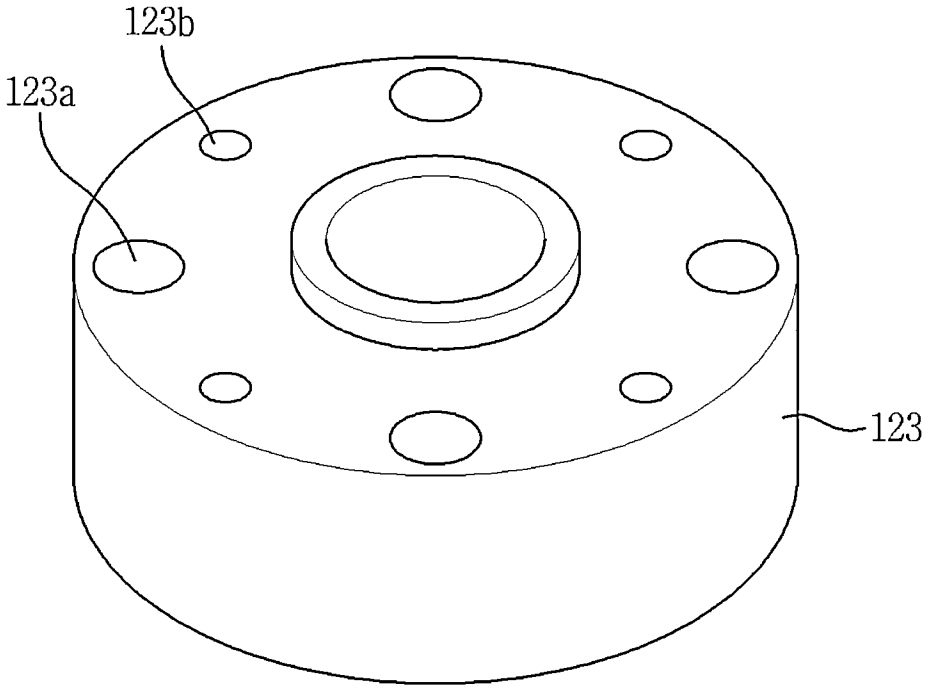
FIG. 9 is a perspective view of a spacer according to the exemplary embodiment of the present invention.

Moreover, as illustrated in FIG. 9, the spacer 123 made of a non-magnetic material may be installed between an upper side of the operating unit 121 and the upper plate 110*b* in order to fill an empty space between the operating unit 121 and the upper plate 110*b*, and prevent the upper plate 110*b* from being magnetized.

In particular, one or more cooling holes 123*a* and one or more fastening holes 123*b* may be formed in one surface of the spacer 123, to which the operating unit cover 121*a* is fastened. As such, as the spacer 123 is disposed on an upper portion of the operating unit 121, heat generated in a process in which the operating unit 121 is vertically vibrated may be easily discharged through the cooling hole 123*a*.

Figure 10:
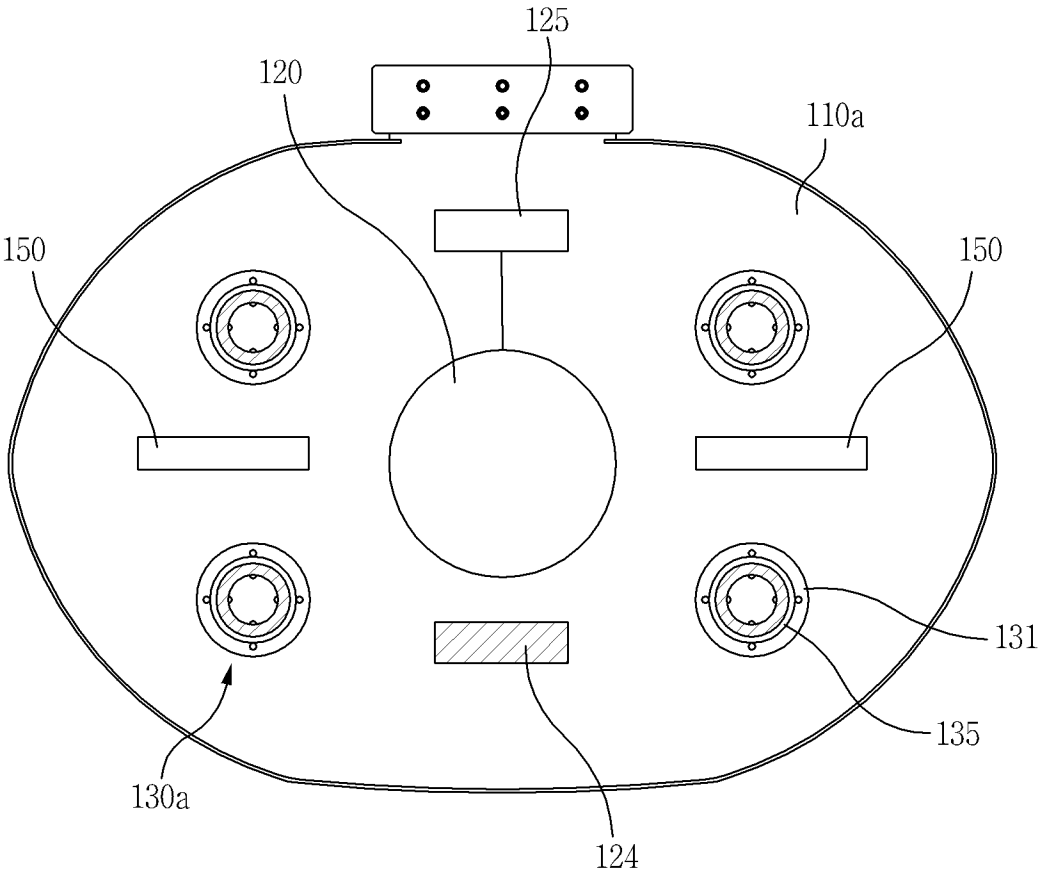
FIG. 10 is an outline view of an inner side of the foot plate according to the exemplary embodiment of the present invention.

Meanwhile, as illustrated in FIG. 10, the drive signal control unit 125 is connected to the vibrator 120 in order to generate vibration by applying a drive signal having a sinusoidal waveform to the vibration generating coil 122*b*. The drive signal control unit 125 may be configured to adjust a frequency, vibration amplitude, time, or the like of the drive signal based on a manipulation of a user.

The vibrator 120 which is described above may form a magnetic circuit by using the vibration generating magnet 121*d* and the electricity generating magnet 121*e*, and drive the operating unit 121 up and down while implementing uniform distribution of magnetic lines of force through the magnetic circuit including the vibration generating magnet 121*d*, and preventing leakage of magnetic flux through the loop-shaped magnetic circuit. Moreover, the vibrator 120 may produce electric energy while implementing uniform distribution of magnetic lines of force through the magnetic circuit including the electricity generating magnet 121*e* and preventing leakage of magnetic flux through the loop-shaped magnetic circuit.

In other words, when a sinusoidal wave drive signal of which polarity is periodically changed is applied to the vibration generating coil 122*b*, a magnetic field of which polarity is alternately changed is generated at the periphery of the vibration generating coil 122*b*, and the magnetic field generates attractive force and repulsive force to vibrate the operating unit 121 based on interaction with a magnetic field generated on the outer ring 121*b* and the inner ring 121*c* by the vibration generating magnet 121*d*. Moreover, when the electricity generating magnet 121*e* is drawn into and out of the circular groove 122*f* by vibration of the operating unit 121, electromotive force is generated at the electricity generating coil 122*d* according to Fleming's right-hand rule.

In particular, the vibration generating magnet 121*d* and the electricity generating magnet 121*e* providing magnetic force of the magnetic circuit may use a magnet strongly magnetized in a magnetization method by using neodymium (Nd) magnetic substance, which has magnetic flux density equal to or greater than several times to dozen times of magnetic flux density of the existing ferrite magnetic substance.

Therefore, in the present invention, because the neodymium magnet having strong magnetic force and directly magnetized in advance is used, inexpensive direct magnetization equipment may be used instead of high priced magnetization equipment using an indirect magnetization method, and therefore equipment investment costs may be reduced, and a period of time for magnetizing may be also shortened because of the direct magnetization method.

In addition, a heat radiation fan 124 is installed at a position spaced apart from the vibrator 120 at a predetermined distance, and operated to cool the vibrator 120 by air when the vibrator 120 excessively radiates heat. The reason is that when a temperature of the vibrator 120 is increased to be equal to or greater than 80° C., for example, magnetic force is weakened, and as a result, performance of vibration and electricity generation functions deteriorates. Therefore, in order to efficiently manage the temperature of the vibrator 120, a temperature at the periphery of the vibrator 120 is detected, and when it is determined that the temperature of the vibrator 120 is increased to be equal to or greater than a predetermined temperature, the heat radiation fan 124 may be operated to discharge heat.

Referring back to FIG. 3, a vibration absorbing unit 130 will be described. The vibration absorbing unit 130 is installed between the upper plate 110*b* and the lower plate 110*a* to allow the upper plate 110*b* and the lower plate 110*a* to be maintained to be spaced apart at a predetermined interval, and absorbs an impact generated when the upper plate 110*b* is lowered while the upper plate 110*b* is vibrated up and down.

The vibration absorbing unit 130 includes a bushing member 130*a* fixed to the lower plate 110*a*, a guide member 130*b* fixed to the upper plate 110*b* at a position corresponding to the bushing member 130*a*, and an absorbing member 135 installed on a circumference of the bushing member 130*a* between the upper plate 110*b* and the lower plate 110*a* and configured to absorb impact generated when the upper plate 110*b* is lowered.

The bushing member 130*a* includes a linear body unit 132, a linear body flange 131, a guide hole 133, a linear bearing 134, and the absorbing member 135, and the guide member 130*b* includes a guide body unit 137, and a guide body flange 136.

Therefore, as the absorbing member 135 is integrally coupled to an outer circumferential surface of the bushing member 130*a*, and the linear bearing 134 is installed on an inner circumferential surface of the bushing member 130*a*, performance of vibration may be improved by efficiently reducing impact generated when the upper plate 110*b* is vertically moved up and down as a vertical up and down motion generated by the vibrator 120 is transferred to the upper plate 110*b*, and noise generated when the vibrator 120 is operated may be remarkably reduced.

Meanwhile, an anion generating member 150 may be additionally installed inside of the foot plate 110 (see FIG. 10). The anion generating member 150 may be installed as an electric anion generating apparatus using a high voltage, but a natural mineral for emitting anions may also be used. In a case in which such anion generating member 150 is installed inside the foot plate 110, anions, which are generated inside the foot plate 110 when the upper plate 110*b* is vibrated, are dispersed to the periphery of the vibratory exercise apparatus 100, and neutralize materials harmful to the human body, and as a result, may double the exercise effect.

While specific exemplary embodiments have been described in the detailed description of the present invention, various modifications may be made without departing from the scope of the present invention. Accordingly, the scope of the present invention is not limited to the exemplary embodiment, and should be determined by not only the appended claims but also by equivalences of the claims.

What is claimed is:

1. A vibratory exercise apparatus having an electricity generating function, comprising:

upper and lower plates formed to be spaced apart from each other at a predetermined interval;

a vibrator configured to vertically vibrate the upper plate up and down including an operating unit fixed to a center of the upper plate, and a bobbin unit installed on the lower plate at a position corresponding to the operating unit and having a coil wound on the bobbin unit and configured to generate a magnetic field by receiving a drive signal; and a vibration absorbing unit installed between the upper plate and the lower plate and configured to absorb an impact generated when the upper plate is lowered while the upper plate is vertically vibrated up and down, wherein the operating unit of the vibrator includes an operating unit cover formed as a circular disk made of a magnetic material and having a plurality of fastening holes for fastening to the upper plate, an outer ring fastened to an edge of the cover and formed in an annular shape having a predetermined height, an inner ring installed to be spaced apart from the outer ring at a predetermined interval while forming a concentric circle inside the outer ring, a center post installed to be spaced apart from the inner ring at a predetermined interval while forming another concentric circle inside the inner ring, a vibration generating magnet made of a ferromagnetic material, attached between one side of the inner ring and the operating unit cover, and configured to magnetize the inner ring and the outer ring, and an electricity generating magnet installed on a protruding end of the center post, and wherein the bobbin unit of the vibrator includes an inner bobbin having a center hole which the electricity generating magnet of the center post is drawn into and out, and an electricity generating coil wound on an outer circumferential surface thereof, an outer bobbin installed to be spaced apart from the inner bobbin at an interval that allows the inner ring of the operating unit to be drawn into and out, while forming a concentric circle outside of the inner bobbin, and having a vibration generating coil wound on an outer circumferential surface thereof, and a bobbin cover coupled to the inner bobbin and the outer bobbin, and having a plurality of fastening holes for fastening to the lower plate.

2. The vibratory exercise apparatus of claim 1, wherein a drive signal control unit, which applies a drive signal having a sinusoidal waveform, is connected to the vibration generating coil of the vibrator.

3. The vibratory exercise apparatus of claim 1, wherein a temperature detection sensor and a heat radiation fan are installed to be adjacent to the vibrator, and the heat radiation fan is operated in accordance with a temperature detected by the temperature detection sensor to cool the vibrator by air.

4. The vibratory exercise apparatus of claim 1, wherein a spacer made of a non-magnetic material and having one or more cooling holes and one or more fastening holes is installed between the upper plate and the vibrator.

5. The vibratory exercise apparatus of claim 1, wherein an anion generating member is installed between the upper and lower plates, such that anions generated by the anion generating member when the upper plate is vibrated are dispersed to a periphery.

* * * * *